US005251421A

United States Patent [19]

Friedrich et al.

[11] Patent Number: 5,251,421

[45] Date of Patent: Oct. 12, 1993

[54] PRESTRESS WIRE SPLICING APPARATUS

[75] Inventors: Ralph S. Friedrich, Hermosa Beach; Ming C. Kuo, Cerritos; Danny I. Wang, Fullerton, all of Calif.

[73] Assignee: Ameron, Inc., Pasadena, Calif.

[21] Appl. No.: 832,788

[22] Filed: Feb. 7, 1992

[51] Int. Cl.[5] ..... E04C 3/10; E04C 5/08; E04G 23/02

[52] U.S. Cl. ..... 52/749; 52/741.1; 52/223.14; 52/248

[58] Field of Search ..... 52/741.1, 223.2, 223.3, 52/223.14, 749, 248, 514; 29/402.9

[56] References Cited

U.S. PATENT DOCUMENTS

| | | | |
|---|---|---|---|
| 2,319,105 | 5/1943 | Billner | 52/223.3 |
| 2,674,115 | 4/1954 | Chalos | 52/223.14 |
| 2,677,957 | 5/1954 | Upson | 52/223.14 |
| 3,422,586 | 1/1969 | Parma | 52/223.14 |
| 3,616,589 | 10/1968 | Sherard | 52/741.1 |
| 3,676,968 | 7/1972 | Campbell | 52/741.1 |
| 4,574,545 | 3/1986 | Reigstad et al. | 52/741.1 |
| 4,713,129 | 12/1987 | Inhofe, Jr. et al. | 52/514 |
| 4,718,965 | 1/1988 | Finsterwalder et al. | 52/223.14 |
| 4,856,254 | 8/1989 | Jungwirth | 52/741.1 |
| 5,043,033 | 8/1991 | Fyfe | 52/514 |

*Primary Examiner*—Carl D. Friedman
*Assistant Examiner*—Wynn E. Wood
*Attorney, Agent, or Firm*—Christie, Parker & Hale

[57] ABSTRACT

A prestress wire splicing apparatus is used to replace sections of wire used in prestressing concrete pipe, where a section of wire has either failed due to corrosion or has been removed for inspection purposes, and to restore the proper amount of tension necessary to keep the concrete pipe in a net overall compression force. The prestress wire splicing apparatus comprises a set of anchor blocks for attachment to the ends of wires, a stop screw for holding a set of the anchor blocks apart, a clamp bolt for securing a set of the blocks together, and a hydraulic clamping device for pressing a set of blocks toward each other. A splice-wire anchor block is attached to each end of a splice wire. An exposed-wire anchor block is attached to each remaining wire end. A clamping device is attached and operated to compress the anchor blocks together to a desired tension force. A clamp bolt is tightened to maintain the tension and the clamping device is removed. Each anchor block has a longitudinal groove with a plurality of teeth spaced apart along its length for engaging a wire with the wire surface flush with the surface of the block.

23 Claims, 4 Drawing Sheets

38
40
30
19
18
21
26
22
21
16
36
32
28

PRESTRESS WIRE SPLICING APPARATUS

FIELD OF THE INVENTION

This invention relates to an apparatus and a method for repairing prestressed concrete pipe by splicing in new prestressing wire to replace an old section of prestressing wire that had either been removed because of failure or for inspection purposes.

BACKGROUND OF THE INVENTION

Concrete is a desirable building material because of its durability, cost and ability to withstand enormous compressive forces. Therefore, concrete has typically been used in those applications where a material was needed to accommodate such compressive loads. Examples of such applications are foundations, pillars, sidewalks and freeways.

Although concrete is known for its ability to handle compressive forces it is equally known for its inability to withstand tension forces. Accordingly, concrete is not a popular building material for use in tension applications. However, the cost and durability of concrete as a building material has inspired investigation into the use of fortified concrete structures in tension service. It was discovered that a concrete structure could be used in a tension service if an external compressive force was applied so that the structure is subjected to a net overall compression force. This method of applying an external compressive force to the concrete structure is called prestressing.

A popular method for prestressing concrete used in tension service is to wrap the concrete structure with high-strength wire under sufficient tension to achieve a net overall compression force on the structure when in service. A popular use of such prestressed concrete is in the formation of concrete pipes. Concrete piping is commonly used in those applications where the cost of alternative materials render their use prohibitive. Examples of such uses include large water mains, dams or other fluid transport systems that are characterized by the large volumes of fluid that must be transported at appreciable internal pressure. Accordingly, the diameter of piping necessary to transport such volumes range from about three feet up to about 22 feet in some applications. Concrete is the most economic building material in these applications due to the amount of material necessary to manufacture such large diameter pipes.

Concrete pipe must be prestressed because its inner diameter will be subjected to the internal hydraulic pressures required for the transport of fluid. This hydraulic pressure exerts a tension force uniformly about the inside diameter of the concrete pipe. In order to keep a net compression load on the pipe while its in service the pipe is wrapped in a continuous spiral of wire subjected to a tension sufficient to overcome the applied internal hydraulic pressure. Accordingly, to insure that the concrete pipe is in net compression it is of extreme importance that the wire wrapped around the concrete pipe be maintained in tension within a precise tolerance range at all times.

After applying and anchoring the prestressing wire, the entire pipe is coated with a concrete mortar in sufficient thickness to embed the wire and protect it from the environment the pipe will encounter in service.

In such applications, it may occur that the wire wrapped around the pipe becomes corroded and may eventually fail. Corrosion may occur, for example, if the mortar coating is broken or cracked. Additionally, in order to determine the condition of such concrete pipes it is often desirable to remove a section of the prestressing wire and inspect the wire for signs of abnormal stress or metallurgical defects. The result of a wire failure due to corrosion or the removal of a section of wire for inspection purposes is the sudden loss of part of the applied compressive force upon the pipe. The loss of the applied compressive force provided by the wire subjects the concrete pipe to the net overall tension force from the internal hydraulic pressure, which may result in the catastrophic failure of the pipe.

Previous efforts to replace wire because of corrosion or for metallurgical testing have been unsuitable. Wire has been cut out and a splice wire welded in place to the remaining ends. The welding not only damages the metallurgical properties of the wire, the spliced piece is not stressed and there may be insufficient prestress in the concrete in the region of the splice.

It is therefore, highly desirable to provide a means for restoring the compressive force applied to the concrete pipe that is necessary to overcome the internal hydraulic pressure after a failure or removal of the prestressing wire has occurred. It is also desirable that this means allow for the application of a known amount of compression upon the concrete pipe and that the means be relatively easy to use.

Ordinary means for stressing the wire when a section is replaced are not suitable since proper prestressing of a cylindrical object such as a pipe requires that the wire fit snugly against the surface of the concrete. Other means for holding and stressing the wire would raise the wire from the pipe surface.

BRIEF SUMMARY OF INVENTION

There is, therefore, provided in practice of this invention according to a preferred embodiment, a prestress wire splicing apparatus capable of replacing a failed or removed section of wire used in prestressed concrete pipe and restoring the precise amount of tension required to maintain a net overall compression force on the pipe while in service. The apparatus comprises a set of splice-wire anchor blocks that attach to each end of the replacement splice wire and a set of exposed-wire anchor blocks that attach to each end of the remaining prestressing wire. Each anchor block comprises means for securing the block to an end of a prestressing wire with the surface of the wire adjacent to a surface of the block. A clamping device is used for applying a desired amount of prestress to a set of anchor blocks connected to the prestressing wires. Bolts are used for securing the anchor blocks together for maintaining the prestress.

For example, a clamp bolt is inserted through a o passage in an anchor block for fastening a set of anchor blocks together. A stop screw protrudes from the surface of such an anchor block to temporarily prevent contact with the adjoining exposed-wire anchor block. A clamping device is temporarily attached to the unassociated ends of one of the joined anchor block sets and the stop screw is backed off.

The clamping device is compressed about the joined anchor block set by means of a hydraulic cylinder, resulting in the application of a desired tension force o upon the prestressing wire. Once the desired tension force has been achieved, the stop screw is adjusted until it contacts the adjoining anchor block's surface and the clamp bolt connecting the anchor block set is tightened until the gauge pressure drops. The clamping device is then retracted and removed.

DETAILED DESCRIPTION

Figure 1:
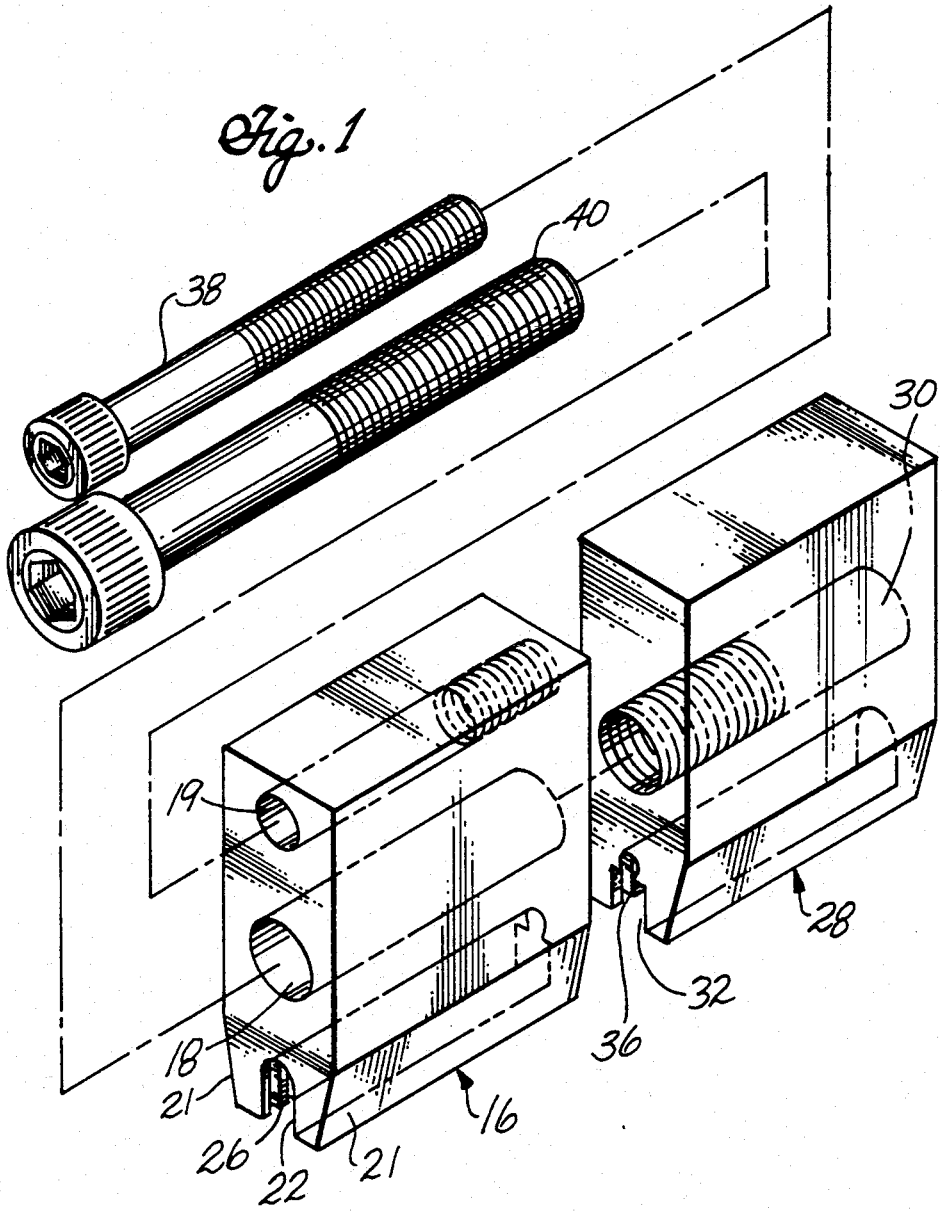
FIG. 1 is a perspective view of the splice-wire and exposed-wire anchor blocks.

In an exemplary embodiment, a prestress wire splicing apparatus comprises a pair of steel splice-wire anchor blocks 16 and a pair of exposed-wire anchor blocks 28. In an exemplary embodiment for ¼ inch prestessing wire, both types of anchor block are rectangular with approximate dimensions of ¾in.×1¾ in.×2 in. Smaller blocks may be used with smaller wire. FIG. 1 illustrates each anchor block as having its 2 inch dimension oriented vertically and its 1¾ inch dimension oriented horizontally. This orientation is maintained for purposes of further describing each different anchor block. It will be understood that this is merely for purposes of exposition and other orientations are used in service.

Figure 2:
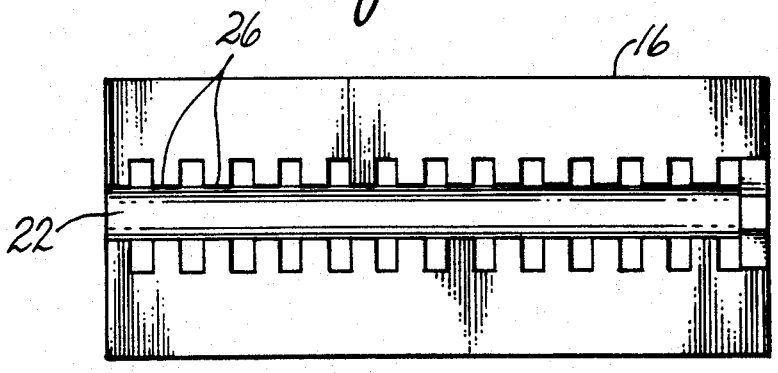
FIG. 2 is an end view of the anchor block's wire receptacle groove.

Both types of anchor blocks have an identical wire receptacle groove 22 and 32 that is integral to the anchor block's bottom surface. As shown in FIG. 2, the wire receptacle comprises a U-shaped groove that is cut longitudinally into each anchor block's bottom surface. Each groove wall comprises a plurality of square teeth 26 and 36. The teeth are created by inserting a broach or cutting device into the initially smooth groove and selectively peeling away a small amount of the groove wall at spaced apart locations, leaving protruding teeth between the cuts. The peeled metal simply piles up in the bottom of the groove (not shown). This cutting method results in a uniform pattern of raised uncut and recessed cut surfaces along the length of both groove walls. The size of the groove cut into the anchor block is chosen to be slightly smaller than the diameter of the prestressing wire being replaced to insure a tight interference fit within the wire receptacle. Such a wire receptacle groove for connecting an anchor block to a prestressing wire is already known and is used at the ends of wires wound around prestressed concrete pipe.

Because of the inherent hardness of the high tensile strength wire (e.g. 250,000 psi) used for prestressing concrete it is necessary that the wire receptacle teeth portion of each anchor block be heat treated to at least a 90 Rockwell 15-N case hardness. The teeth are heat treated so that they will cut into the surface of the hard prestressing wire when the wire is introduced into each anchor block's wire receptacle groove, thus ensuring a tight grip. Before heat treating, the anchor blocks must be specially prepared to ensure that only the tooth portion of each anchor block receive the hardening treatment. This step is necessary to ensure that those regions of each anchor block subjected to a localized force (such as adjacent holes through the block) will not be adversely affected by the brittleness often associated with hardening.

The blocks are prepared by carburizing or case hardening the teeth. The balance of the block is "stopped off" during carburizing so that only the teeth have case hardening. The block is then heat treated to obtain the desired hardness in the teeth while leaving residual ductility in the body of the anchor block.

FIG. 1 shows the splice-wire anchor block 16 and the exposed-wire anchor block 28. Each splice-wire anchor block 16 has an stop screw hole 19 running longitudinally through the anchor block parallel to the wire receptacle groove 22. The stop screw hole is centered approximately ¼ inch. from the top surface of the anchor block and has a diameter of approximately 5/16 inch. The screw hole is counterbored approximately 1¼ inch from one end and threaded the remaining ½ inch of its length.

The splice-wire anchor block also has a clamp bolt hole 18 running longitudinally through the anchor block near the middle of the block and parallel to both the wire receptacle groove and the stop screw hole 19. The clamp bolt hole is centered approximately 1 inch from the top surface of the anchor block and has a diameter of approximately 15/32 inches. The clamp bolt hole in the splice-wire anchor block is unthreaded.

The exposed-wire anchor block 28 also has a clamp bolt hole 30 approximately centered between block's surfaces and extending longitudinally through the anchor block parallel to the wire receptacle. The clamp bolt hole is identically positioned within each type of anchor block to permit alignment of the holes when the two types of anchor block are drawn together. The clamp bolt hole has a diameter of approximately 15/32 inches. However, unlike the splice-wire anchor block's clamp bolt hole 18, exposed-wire anchor block's clamp bolt hole 30 is partially threaded approximately ¾ inch from one end. The exposed-wire anchor block also does not have a stop screw hole, although it may have a shallow depression (not shown) for receiving the end of a stop screw.

A stop screw 38 fits within the stop screw hole 19. In an exemplary embodiment for ¼ inch diameter wire, the stop screw comprises a socket head cap screw, 5/16-24 UNF×2½ inches long. A clamp bolt 40 fits within the clamp bolt hole 18 and 30 of each type of anchor block. The clamp bolt comprises a socket head cap screw, 1/16-20 UNF×3 inches long.

The spacing between adjacent wires on a prestressed concrete pipe may be quite close. The minimum dimension between wires, center-to-center, is twice the wire diameter. Thus, to fit an anchor block between adjacent wires, the dimension from the wire groove to each face of the block shouldn't be more than the diameter of the wire. For smaller size blocks, a taper 21 is provided along each face parallel to the groove to narrow the block so if fits between the wires while maintaining adequate thickness and strength nearer the holes through the blocks.

If a number of adjacent wires are spliced, the exposed ends of the wires are cut to different lengths so that anchor blocks on adjacent wires are staggered from each other and do not interfere with each other.

Figure 4:
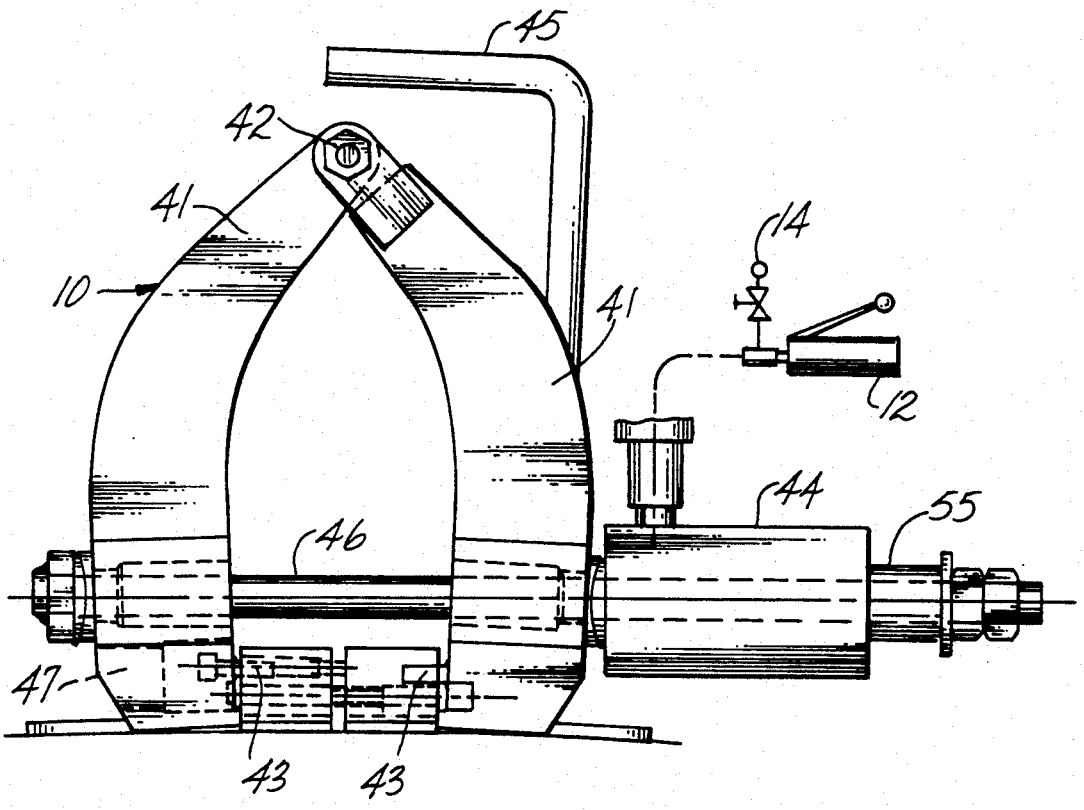
FIG. 4 is a side view of the clamping device attached to an anchor block set.

A clamping device 10 is shown in FIG. 4. The clamping device comprises a pair of curved steel jaws 41 connected by a hinge pin 42 at one end and open at the other end. The distance between the clamp's open jaws is approximately five inches to permit the clamp to fit around a set of anchor blocks. A pair of guide bars 43 on each jaw of the clamping device straddle the respective blocks and keep the assembly of anchor blocks in alignment. A handle 45 is secured to one jaw of the rather heavy device for moving it about.

The clamping device is activated by a hydraulic pump 12 that provides the means for compressing the clamp. The pump is connected to a hydraulic cylinder 44. The piston 55 of the hydraulic cylinder is hollow. A bolt 46 extends through the hollow piston and is connected to the far jaw of the device for pulling the jaws toward each other. This type of connection is used for a cylinder that exerts an expansion force. If one used a cylinder which contracts upon application of hydraulic pressure, the cylinder could be mounted between the jaws of the clamp. A hydraulic pressure gauge 14 is attached to the pump for monitoring the pressure applied to the clamp. The gauge monitors the hydraulic pressure applied to the clamp and is sized to accommodate the amount of applied pressure necessary to restore the net overall compression force.

Figure 3:
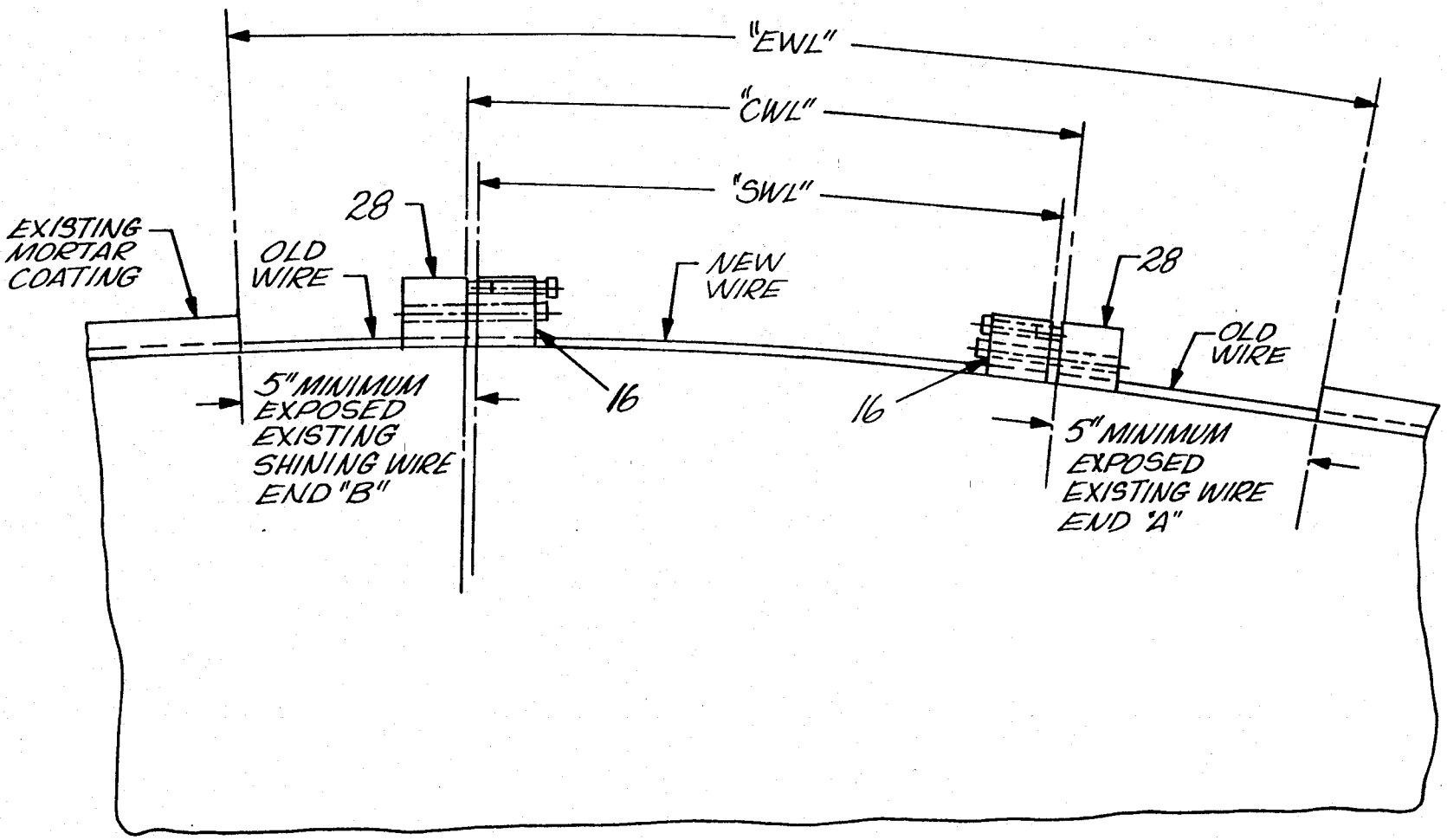
FIG. 3 is a side view of the wire lengths and the anchor blocks assembled in their final position.

The prestress wire splicing apparatus is used after removing the mortar coating surrounding the corroded wire section or section of wire to be sampled. The splice area is prepared by cutting out any corroded or damaged wire so that the remaining exposed wire ends are shining and unpitted. As shown in FIG. 3, the remaining wire ends must be exposed and clear of the mortar coating for at least five inches. The cutoff old wire length (CWL) is then measured.

To ensure a uniform wire tension across the new splice wire the CWL should be in the range of from eight inches to eight feet. If it is less than about eight inches, there is insufficient length to work with in applying the blocks and applying tension. The maximum length depends in part on the diameter of the pipe, larger diameter pipes permitting longer lengths. The length must be short enough that friction of the wire around the curved pipe as it is again stressed does not leave a low stress region.

The exposed wire length (EWL) is then measured. This length comprises the distance between the end of the wire and the point at each remaining wire end where the wire just becomes exposed from the remaining mortar. A new prestress splice wire is chosen having the same diameter as the removed portion. The length of new splice wire (SWL) is to be determined from the formula $SWL = CWL - 0.50 - (EWL \times 0.005)$. This formula insures that the splice wire is of the proper length to accommodate the necessary tension applied by the wire splicing apparatus.

The splice-wire assembly is next prepared by inserting a stop screw 38 into the counterbore side of the stop screw hole 19 of each splice-wire anchor block 16. The stop screw is then run into each stop screw hole until it protrudes approximately ½ inch from the splice-wire anchor block is then positioned over each splice wire end such that the wire is aligned with the anchor block's wire receptacle groove 22 and each wire end terminates at the anchor block surface having the protruding stop screw. Each splice wire end is then forced into each wire receptacle groove by either a hammer or a press. The wire is forced into the block until it is flush with the surface adjacent the receptacle groove.

The exposed-wire assembly is prepared by positioning each exposed-wire anchor block over an exposed wire end such that the wire is aligned with the anchor block's wire receptacle groove and each wire end is flush with the end of the respective anchor block near the centerboard clamp bolt hole. Each exposed-wire anchor block is then driven onto the exposed wire end with a hammer for embedding the wire in the groove flush with the surface of the block. A protective shim is temporarily placed between the concrete pipe and each anchor block to protect the concrete as a block is hammered onto a wire. A press may also be used for forcing a wire transversely into the groove of an anchor block.

The splice wire assembly, comprising the splice wire and a splice-wire anchor block attached at each splice wire end, is then positioned between the exposed-wire anchor blocks attached to the exposed wire ends. The blocks are all positioned with the wire receptacle groove facing the surface of the pipe. This places the wire adjacent to the surface for best applying prestress to the concrete.

Once the splice wire assembly is in place, a clamp bolt 40 is used to attach each splice-wire anchor block to its adjoining exposed-wire anchor block. The clamp bolt is installed by first inserting it through each splice-wire anchor block's unthreaded clamp bolt hole 18 and into the threaded clamp bolt hole 30 of each exposed-wire anchor block. Each set of anchor blocks are then drawn together by tightening each clamp bolt until the protruding stop screw 38 contacts the exposed-wire anchor block's adjoining surface. During this procedure the clamping device 10 may be used without hydraulic pressure to help align each anchor block set and control their twisting during tightening.

Once both anchor block sets, comprising a splice-wire anchor block and an exposed-wire anchor block, are securely tightened, the clamping device 10 is attached to one set of anchor blocks as shown in FIG. 4. The clamping device are then tightened until both jaws contact the unassociated ends of each anchor block. The stop screw 38 is backed out from its protruding position until it is flush with the surface of the splice-wire anchor block.

It is desirable at this point to install a stout protective shield over or around the work site so that a broken or loosened wire is contained and there is no hazard to workmen.

The hydraulic pump 12 is operated to apply a compression force upon the clamping device and the anchor block set. The amount of hydraulic pressure applied to the anchor block set is monitored through the hydraulic pressure gauge attached to the hydraulic pump. The amount of hydraulic pressure required to restore the proper measure of tension necessary to maintain a net overall compression force on the concrete pipe is dependent on the size of the prestress wire being replaced. Typically the tension in the wire is about 70% of the ultimate strength of the wire. The amount of prestress applied is dependent on the size of the original wire on the pipe. Some pipes have been reinforced with #8 gauge wire, which is no longer available in a suitable high strength. Such a wire may be spliced with a #6 gauge wire which has a larger diameter. The stress in the larger wire is lower than in the original wire for a given prestess on the concrete. When two sizes of wire are involved, the exposed-wire and splice-wire blocks in a set have different size grooves.

Once the proper amount of pressure has been applied, the stop screw 38 is run into the splice-wire anchor block until it just contacts the exposed-wire anchor block's adjoining surface. A passage 47 is provided through one of the jaws of the clamping device for access to the screws by an allen wrench. The clamp bolt 40 is then tightened until the hydraulic gauge pressure drops approximately 10%. After the clamp bolt has been tightened the hydraulic pressure can be relieved from the clamping device and it can be removed.

The stop screw amounts to an adjustable thickness spacer since it spaces the anchor blocks apart after the required tension has been applied to the wires. The same result can be obtained by securing a shim or spacer of the proper thickness so as to fit snugly between the blocks.

The stop screw acts as a fulcrum for the moment in the anchor blocks. The connected wires tend to pull the blocks apart adjacent to the surface of the concrete. The clamp bolt tends to pull the blocks together in about the middle of the blocks. The stop screw balances the moment from these counter directed forces.

After the removed section of the original wire is replaced with a splice wire, the hole cut in the mortar for performing the splicing is plastered over with mortar to protect the splice wire and anchor blocks from corrosion.

The use of the apparatus according to this method enables one to replace a removed portion of prestress wire and apply the amount of tension necessary to restore the net overall compression force to the concrete pipe. By using anchor blocks with a groove along one face, the wire can be held against the concrete, which is not feasible with other types of anchor blocks. Welding of the wire is avoided. The blocks provide a means for mechanically holding the wire for engagement by the clamping device for applying the same prestress to the concrete as applied by the original wire.

Although but one exemplary embodiment of a prestressing apparatus has been described, many variations will be apparent to those skilled in the art.

For example, instead of joining together a set of splice-wire anchor blocks to a set of exposed-wire anchor blocks, one set of anchor blocks may be replaced with an alternative junction anchor block. Such an anchor block comprises a one-piece rectangular metal block having two wire receptacle grooves or one longer groove to accommodate both a splice wire and an exposed wire. In effect, the junction wire block comprises an integral splice-wire and exposed wire anchor block.

This type of junction anchor block serves only as a means of joining the wires together and does not accommodate the application of a tension force. Accordingly, a splice-wire anchor block and an exposed-wire anchor block as described in the exemplary embodiment is used at the remaining splice-wire and exposed wire ends in order to apply the tension necessary to restore the net overall compression force to the concrete pipe.

Such an embodiment is suitable for short splices. Using two pairs of exposed-wire and splice-wire anchor blocks allows part of the stress to be applied to the wire by one pair of anchor blocks and the balance of the stress to be applied by the other pair of anchor blocks. This may be useful to accommodate the elongation of a longer splice wire. For longer splices where friction between the wire and concrete is appreciable, tightening via both sets of anchor blocks is preferred for obtaining uniform tension in the wires. Typically one uses four anchor blocks since the inventory of blocks is all the same, regardless of whether short or long replacements are being made. When a short splice is made, one set of anchor blocks is secured together with only a small gap between them. The entire tension is then applied by way of the other set of anchor blocks.

The mechanism for applying tension to the wires by way of the anchor blocks may have other forms than described and illustrated. For example, instead of having a hydraulic cylinder between the pivot for the two arms of the mechanism and the end where pressure is applied to the anchor blocks, the mechanism can have the cylinder beyond a central pivot of a scissors-type mechanism. A hydraulic cylinder is useful since the tension applied to the wire can be readily determined by reading gauge pressure. A screw mechanism or equivalent could also be used.

Since many such modifications may be made, it is to be understood that within the scope of the following claims, this invention may be practiced otherwise than specifically described.

What is claimed is:

1. A method for repairing a section of concrete prestressing wire by splicing in a new section of wire comprising the steps of:

removing a portion of prestressing wire and preparing each remaining exposed wire end such that it is clean and undamaged;

cutting a prestressing splice wire to approximately the same length as the removed portion;

installing a splice-wire anchor block onto each end of the splice wire;

installing an exposed-wire anchor block onto each exposed wire end;

attaching each splice-wire anchor block to an exposed-wire anchor block;

applying a clamping device to a set of attached anchor blocks and compressing the anchor blocks together until a desired wire tension is achieved;

fastening the attached anchor blocks together for retaining a desired prestress tension in the wires; and releasing and removing the clamping device.

2. The method as recited in claim 1 wherein one set of splice-wire and exposed wire anchor blocks are an integral junction anchor block, the step of installing the anchor blocks on each splice wire end comprises attaching one end of the splice wire to a splice-wire anchor block and the other end to a junction anchor block, and the step of installing an anchor block on an exposed wire end comprises attaching the exposed wire end to the junction anchor block.

3. A method as recited in claim 1 wherein each anchor block comprises a wire receptacle groove having a plurality of teeth along the groove and the steps of attaching a wire to an anchor block comprises forcing a wire into the groove until flush with the surface of the block.

4. The method as recited in claim 1 wherein the step of attaching the anchor blocks together comprises aligning the blocks, placing a spacer between the blocks, and tightening a fastening means connecting the anchor blocks for compressing against the spacer.

5. A method as recited in claim 1 comprising placing the attached wire in each anchor block flush with a concrete surface before compressing the anchor blocks together.

6. A method for splicing in a new wire to replace a removed section of prestressing wire used in prestressed concrete pipe, the method comprising the steps of:

clearing away any mortar coating surrounding the prestressing wire for exposing a portion of the prestressing wire to be removed;

cutting out sufficient wire that all remaining exposed wire is clean and undamaged;

measuring the length (CWL) of the cut off old wire;

measuring the length (EWL) of the exposed wire;

cutting a length of new splice wire for fitting between the ends of the exposed wires;

attaching a splice-wire anchor block to each end of the new splice wire;

attaching an exposed-wire anchor block to each end of the exposed wire;

positioning the splice wire and the attached splice-wire anchor blocks between the respective exposed wire ends such that each splice-wire anchor block adjoins an exposed-wire anchor block;

loosely fastening together each splice-wire anchor block to its adjoining exposed-wire anchor block;

attaching a clamping device to one set of the fastened anchor blocks;

compressing together the set of anchor blocks with a hydraulic clamping device to a sufficient pressure to restore a desired prestress;

securing the set of anchor blocks together with sufficient force that the hydraulic pressure decreases; and releasing and removing the clamping device from the set of anchor blocks.

7. A method as recited in claim 6 wherein the step of securing cómprises fixing a rigid spacer between a portion of the anchor blocks remote from the wires and bolting the blocks together in a location between the spacer and the wires.

8. A method as recited in claim 7 wherein the step of fixing a rigid spacer comprises installing a stop screw in such an anchor block and advancing the stop screw to contact the other anchor block.

9. A method as recited in claim 8 wherein the stop screw is installed into such an anchor block and advancing the stop screw forward until it protrudes from the anchor block's surface for providing a temporary spacing between the blocks before applying a clamping force, retracting the stop screw rearwardly to at least the anchor block's surface when applying the clamping force, and advancing the stop screw forwardly to contact the other anchor block's surface before releasing the clamping force.

10. A method as recited in claim 6 wherein the new splice wire length "SWL"$=$CWL$-0.50-$(EWL$\times 0.005$) where SWL, CWL and EWL are in inches.

11. A method as recited in claim 6 wherein each wire end is installed into its respective anchor block such that a side of the wire is flush with the anchor block surface adjacent to the concrete surface.

12. A method as recited in claim 6 wherein each anchor block comprises a groove in one face having a plurality of teeth along the length of the groove and the step of attaching such an anchor block to a wire end comprises forcing the anchor block onto the wire transverse to the groove.

13. An apparatus for replacing a section of prestressing wire installed on prestressed concrete pipe and for restoring the proper amount of prestress tension comprising;

a splice-wire anchor block;

an exposed-wire anchor block, each anchor block comprising means for securing the block to an end of a prestressing wire with the surface of the wire adjacent to a surface of the block;

means for applying a desired amount of prestress to a set of anchor blocks connected to prestressing wires; and means for securing the anchor blocks together for maintaining the prestress.

14. An apparatus as recited in claim 13 wherein the each anchor block comprises:

a metal block having a wire receptacle groove in one face of the block;

a plurality of teeth along the length of the wire receptacle groove for retaining an end of a prestressing wire;

a hole extending longitudinally through the anchor block parallel to the wire receptacle groove; and a bolt for securing adjacent anchor blocks together by way of the holes in adjacent anchor blocks.

15. An apparatus as recited in claim 13 wherein the means for applying a desired amount of prestress to the combined anchor blocks comprises a clamp having a pair of jaws for engaging the unassociated ends of a set of combined anchor blocks and means for forcing the jaws toward each other.

16. An apparatus as recited in claim 13 wherein one of the anchor blocks comprises a threaded hole and a stop screw in the hole for engaging the surface of the other block and a second hole for receiving a clamp bolt for connecting adjacent anchor blocks together.

17. An apparatus as recited in claim 16 wherein the threaded hole is nearer the surface of the block opposite from the surface adjacent to the wire, and the second hole for receiving a clamp bolt is between the wire and the stop screw.

18. A wire splicing apparatus for replacing a section of wire removed from a prestressed concrete pipe and restoring the tension force necessary to maintain a net overall compression force, the apparatus comprising;

a set of splice-wire anchor blocks each having an elongated wire receptacle for receiving an end of a replacement splice wire;

a set of exposed-wire anchor blocks each having an elongated wire receptacle for receiving an end of a remaining prestressing wire on the concrete pipe;

means for temporarily preventing full contact between the adjoining splice-wire anchor block and exposed-wire anchor block surfaces;

means for compressing together a splice-wire anchor block and an adjacent exposed-wire anchor block; and means for securing each splice-wire anchor block to an adjoining exposed-wire anchor block for maintaining prestress in the wires upon removal of the means for compressing.

19. An apparatus as recited in claim 18 wherein the wire receptacle of each block comprises a generally U-shaped groove extending longitudinally along the anchor block's surface and a plurality of teeth spaced apart along the length of the groove.

20. An apparatus as recited in claim 18 wherein one of the anchor blocks comprises a stop screw hole adjacent the anchor block's surface opposite the wire receptacle and parallel to the wire receptacle, and each anchor block comprises a clamp bolt hole near the middle of the block and parallel to the wire receptacle.

21. An apparatus as recited in claim 18 wherein the means for preventing full contact between the adjoining splice-wire anchor block and exposed-wire anchor block surfaces comprises a stop screw in one of the anchor blocks for engaging the other anchor block.

22. An apparatus as recited in 21 wherein the means for securing the splice-wire anchor block to an adjoining exposed-wire anchor block comprises a clamp bolt for bolting the two blocks together between the stop screw and the wire receptacle.

23. An apparatus as recited in 18 wherein the means for compressing together anchor blocks comprises a clamping device having a hydraulic pump for applying a compressive force, the clamping device having a hydraulic pressure gauge for monitoring the compressive force applied to the anchor blocks.

* * * * *

UNITED STATES PATENT AND TRADEMARK OFFICE

CERTIFICATE OF CORRECTION

PATENT NO. : 5,251,421

DATED : October 12, 1993

INVENTOR(S) : Ralph S. Friedrich; Ming C. Kuo; Danny L. Wang

It is certified that error appears in the above-indentified patent and that said Letters Patent is hereby corrected as shown below:

Column 4, line 43, change "1/16-20" to -- 7/16-20 --.

Column 5, line 51, before "splice-wire" insert

-- opposite surface of the splice-wire anchor block. Each --.

Signed and Sealed this

Seventeenth Day of May, 1994

Bruce Lehman

*Attest:*

BRUCE LEHMAN

*Attesting Officer*

*Commissioner of Patents and Trademarks*